US005720073A

United States Patent [19]

Kamada

[11] Patent Number: 5,720,073

[45] Date of Patent: Feb. 24, 1998

[54] MOP THREAD-SQUEEZING APPARATUS

[75] Inventor: Katsuzo Kamada, Shiga-ken, Japan

[73] Assignee: Yugengaisha Access, Shiga-ken, Japan

[21] Appl. No.: 608,286

[22] Filed: Feb. 28, 1996

[30] Foreign Application Priority Data

Mar. 3, 1995 [JP] Japan ..... 7-043890
Mar. 3, 1995 [JP] Japan ..... 7-043892

[51] Int. Cl.[6] ..... A47L 13/59

[52] U.S. Cl. ..... 15/261; 68/241; 100/132; 100/288

[58] Field of Search ..... 15/260–263; 68/241; 100/132, 288

[56] References Cited

U.S. PATENT DOCUMENTS

| | | | |
|---|---|---|---|
| 707,235 | 8/1902 | Von Kanel | 15/261 |
| 1,128,083 | 2/1915 | Welch | 15/261 |
| 1,351,805 | 9/1920 | Speckman | 15/261 |
| 1,659,505 | 2/1928 | Welch et al. | 15/261 |
| 1,871,903 | 8/1932 | Neldner . | |
| 2,199,906 | 5/1940 | Bard | 15/261 |
| 2,275,461 | 3/1942 | Palmer | 15/261 |
| 2,651,073 | 9/1953 | Roe | 15/261 |
| 3,452,379 | 7/1969 | Bard | 15/261 |

FOREIGN PATENT DOCUMENTS

| | | | |
|---|---|---|---|
| 28533 | 9/1921 | Denmark | 15/261 |
| 855357 | 2/1940 | France | 15/261 |
| 43 02 915 | 8/1994 | Germany . | |
| 2214417 | 9/1989 | United Kingdom . | |

*Primary Examiner*—Mark Spisich
*Attorney, Agent, or Firm*—Merchant, Gould, Smith, Edell, Welter & Schmidt

[57] ABSTRACT

A mop thread-squeezing apparatus capable of compressing mop thread sufficiently without deteriorating the operability thereof, by applying a great pressing force to the mop thread. A pinion fixed to a driving shaft and a rack supporting one end of a squeezing plate are installed on each of left and right side plates of a squeezing tank. A radius of a pitch circle of the pinion at a point of contact between the pitch circle of the pinion and a pitch line of the rack becomes gradually smaller in a region corresponding to a former half time period of a lever operation and is almost constant in a region corresponding to a latter half time period of the lever operation. In the former half time period of the lever operation, a squeezing plate moves downward rapidly and thus the amount of the downward movement thereof is great, whereas in the latter half time period of the lever operation, the radius of the pitch circle becomes smaller and thus the pressing force of the squeezing plate becomes greater.

3 Claims, 10 Drawing Sheets

MOP THREAD-SQUEEZING APPARATUS

BACKGROUND OF THE INVENTION

1. Field of Industrial Application

The present invention relates to a mop thread-squeezing apparatus, and more particularly to a mop thread-squeezing apparatus used to squeeze the thread of a mop for cleaning a floor or the like after washing the mop thread.

2. Prior Art

Heretofore, as shown in FIG. 1, in cleaning floors of buildings, factories and the like, a mop 1 comprising a handle 2 and a mop thread 3 installed at an end of the handle 2 is used. When the mop thread 3 becomes soiled, an operator immerses the mop thread 3 in a cleaning container 80 containing cleaning liquid. As shown in FIG. 3, the washed mop thread 3 is squeezed by the mop thread-squeezing apparatus 4 which is hooked on an upper edge 83 of the cleaning container 80. As shown in FIGS. 4 and 5, a cut-out 52 is formed at a lower portion of each of left and right side plates 50*a* and 50*b*; and a peripheral wall 82 of the cleaning container 80 is inserted or hooked into the cut-outs 52 so as to fix the mop thread-squeezing apparatus 4 to the upper edge 83 of the peripheral wall 82.

In the mop thread-squeezing apparatus 4 fixed to the interior of the cleaning container 80, the mop thread 3 washed in the cleaning liquid 90 by putting it thereinto from an opening 86 of the cleaning container 80 is moved downward to insert the mop thread 3 into the interior 13 of the apparatus 4. The mop thread 3 inserted into the interior 13 is squeezed by mop thread-pressing members by pivoting the lever 14 of the apparatus 4 in a direction shown by an arrow 19.

As illustrated in FIG. 2, rollers 7*a* and 7*b* serving as the mop thread-pressing members are moved downward by operating the lever 14, thus compressing the mop thread 3 placed on the bottom 9 of the interior 13 of the apparatus 4 and squeezing out the cleaning liquid 90 contained in the mop thread 3. In the above description, the rollers 7*a* and 7*b* are shown as the mop thread-pressing members for brevity, but practically, pressing plates of a rotary type are frequently used. Generally, at the start of the operation of the lever 14, the interval between the pair of mop thread-pressing members is large to facilitate the insertion of the mop thread 3 therebetween. The interval gets smaller with the progress of the operation of the lever 14 and becomes constant in a latter half time period of the operation of the lever 14 in which the mop thread is compressed.

The mop thread-squeezing apparatus 4 comprises driving mechanisms 7 as shown in FIG. 6 to drive the mop thread-pressing member 7*a* and 7*b* by means of the lever 14. The driving mechanism 7 is mounted on each side plate 50*a* and 50*b* of the mop thread-squeezing apparatus 4 and has a circular pinion 5 and a straight rack 6 which engages the pinion 5. The pinion 5 is fixed to a driving shaft to which the lever 14 is fixed. The rack 6 is vertically movable in engagement with the pinion 5 and has a pair of the mop thread-pressing members 7*a* and 7*b* mounted on the lower end thereof. When the lever 14 is pivoted in the direction shown by the arrow 19, the mop thread-pressing members 7*a* and 7*b* mounted on the rack 6 move downward together therewith.

The conventional mop thread-squeezing apparatus 4 having the above-described driving mechanisms 7 has a problem that the mop thread-pressing members 7*a* and 7*b* are incapable of squeezing the mop thread 3 sufficiently due to the lack of a force for pressing the mop thread 3. In other words, it is not easy to increase the pressing force of the mop thread-pressing members 7*a* and 7*b* in order to squeeze the mop thread 3 sufficiently.

That is, as shown in FIG. 6, in the driving mechanism 7, supposing that a pressing force generated in the mop thread-pressing members 7*a* and 7*b* is (P); the radius of a pitch circle is (R); the length of the arm of the lever 14 is (L); and an operation force is (F), there is the following relationship among (P), (R), (L), and (F): $P \times R = F \times L$. Thus, the pressing force (P) is expressed as $P = (L/R) \times F$. That is, the operation force (F) is inversely proportional to the ratio (L/R) of the length (L) of the arm of the lever 14 to the radius (R) of the pitch circle of the pinion 5. Therefore, apparently, in order to increase the pressing force (P), it is necessary to reduce the radius (R) of the pitch circle of the pinion 5 and increase the length (L) of the arm of the lever 14 and the operation force (F).

When the radius (R) of the pinion 5 is set to be too small, the vertical movement of the mop thread-pressing members 7*a* and 7*b* relative to a rotation angle of the lever 14 is small. In this case, it is inconvenient to use the mop thread-squeezing apparatus 4. Further, it is necessary to operate the lever 14 of the mop thread-squeezing apparatus 4 placed on the cleaning container 80 by pivoting it about 120°–150° in consideration of the operability thereof. Thus, it is difficult in practice to secure a required vertical movement of the rack 6 by increasing the rotation angle of the lever 14, namely, the rotation angle of the pinion 5. Accordingly, there is a limitation in the length of the radius (R) of the pinion 5.

Furthermore, in order for an operator standing by the cleaning container 80 to operate the lever 14 with one hand while the operator holds the mop 1 with the other hand, there is also a limitation in the length L of the arm of the lever 14.

Ordinary persons have limits in the generation of the operation force (F).

Therefore, in the conventional mop thread-squeezing apparatus 4 having the above-described construction, it is difficult to increase the pressing force (P) by decreasing the radius (R) of the pinion 5 and increasing the length (L) of the arm of the lever 14 and the operation force (F), because of the above-described limitation.

That is, in the conventional mop thread-squeezing apparatus 4 having the driving mechanism 7, there is a limitation in the pressing force (P) of the mop thread-pressing members 7*a* and 7*b*. Thus, it is not easy to solve the problem that the mop 3 cannot be compressed sufficiently.

In addition to the above-mentioned inconvenience, there are the other problems in the conventional apparatus, which is described below in detail. There is a container exclusively used as the cleaning container 80, but a vacant can is frequently utilized as the cleaning container 80 to lower manufacturing cost. That is, containers for exclusive use for the cleaning container 80 can be prepared, but a pail can having a volume of about 20 liters and used as a container for containing wax is frequently used, with a carrier installed thereon. In this case, the following problems occur.

That is, in such a mop thread-squeezing apparatus 4 of hook type, the mop thread-squeezing apparatus 4 tilts owing to a moment caused by the operation of the lever 14; and an edge 53 of a cut-out formed at a lower portion of the mop thread-squeezing apparatus 4 is brought into contact with the peripheral wall 82 of the cleaning container 80, thus applying a force to the peripheral wall 82 in a direction almost perpendicular thereto and concaving and damaging the peripheral wall 82. This problem can be solved to a certain extent by using a protector or increasing the area of contact between the edge 53 and the peripheral wall 82, but cannot be solved fundamentally.

SUMMARY OF THE INVENTION

Accordingly, an essential objective of the present invention is to provide a mop thread-squeezing apparatus capable of compressing mop thread sufficiently without deteriorating the operability thereof, by applying a great pressing force to the mop thread by operating a lever.

Another objective of the present invention is to provide the same apparatus which does not damage a cleaning container when a lever is operated.

In order to achieve the aforementioned objectives, the present invention provides the mop thread-squeezing apparatus with the following construction.

The mop thread-squeezing apparatus comprises a pinion to be rotated by a means of a lever which has a row of teeth having first and second ends and a rack engaging the pinion so as to be moved downward and upward due to a rotation of the pinion. The rack includes a row of teeth which corresponds to the row of teeth of the pinion and has a lower end, at which the teeth thereof engage the teeth of the pinion positioned at the first end of the row of teeth, and an upper end at which the teeth thereof engage the teeth positioned at the second end of the row of teeth. The apparatus further includes a mop thread-pressing member which is moved downward and upward together with the rack by operating the lever to compress a mop thread so as to squeeze cleaning liquid contained therein. A pitch circle of the pinion extending between the first and second ends of the row of the teeth is uncircular such that a radius of the pitch circle becomes gradually smaller from the first end of the row of teeth toward the second end thereof.

In the above-described construction, a pitch line of the row of teeth of the rack is straight or curved in correspondence to the pitch circle of the pinion engaging the rack. The radius of the pitch circle of the pinion at the point of contact between the pitch circle of the pinion and the pitch line of the rack becomes substantially gradually smaller, with the progress of a squeezing operation by means of the lever. Thus, the pressing force (P) of the mop thread-pressing member to be transmitted to the mop thread through the rack, namely, the pressing force acting thereon becomes gradually greater: When a constant operation force (F) acts on the lever having a length (L), the radius (R) of the pitch circle of the pinion becomes gradually smaller. Thus, the pressing force (P) of the mop thread-pressing member expressed as $P=(L/R)\times F$ becomes gradually greater.

With the progress of the compressing operation by operating the lever, the change in the movement amount of the rack and the mop thread-pressing members becomes gradually smaller. That is, in about the former half time period before the mop thread-pressing member starts to compress the mop thread, the rack and the mop thread-pressing member have a large movement amount, whereas in about the latter half time period in which the mop thread-pressing member compresses the mop thread, the rack and the mop thread-pressing member have a small movement amount. If the movement amount of the mop thread-pressing member is distributed appropriately in the former half time period of the lever operation and in the latter half time period thereof, the whole operation amount (pivotal range) of the lever can be allowed to be equal to that of the lever of the conventional apparatus. Thus, the operability of the lever cannot be deteriorated. In other words, in the latter half time period of the lever operation, the movement amount of the mop thread-pressing member is set to be small to generate a great pressing force, while in the former half time period of the lever operation in which the force for pressing the mop thread is not required, the movement amount of the mop thread-pressing member is set to be great. In this manner, the movement amount of the mop thread-pressing member can be allowed to be equal to that of the mop thread-pressing member of the conventional apparatus.

Accordingly, the mop thread-squeezing apparatus having the above-described construction is capable of compressing the mop thread sufficiently without deteriorating the operability thereof, by applying a great pressing force to the mop thread by operating the lever.

It is preferable in the above construction that the row of teeth of the pinion have a first region including the first end of the row of teeth in which leading half teeth engage lower half teeth of the rack in a former half time period of the squeezing operation by means of the lever, in which the radius of the pitch circle of the pinion becomes gradually smaller from the first end of the row of teeth toward the other end thereof; and that the row of teeth of the pinion have a second region including the second end of the row of teeth in which trailing half teeth engage lower half teeth of the rack in a latter half time period of the squeezing operation by means of the lever, in which the radius of the pitch circle of the pinion is approximately constant.

In the above construction, in the former half time period of the operation of the lever, the movement amount of the mop thread-pressing member is set to be large. On the other hand, in the latter half time period of the operation of the lever, the pressing force of the mop thread-pressing member is set to be almost constant because the radius of the pitch circle of the pinion is set to be almost constant; and further, the movement amount of the mop thread-pressing member is set not to be too small to secure the movement amount of the mop thread-pressing member appropriately. Thus, the operability of the lever is not deteriorated. That is, because the radius of the pitch circle of the pinion is set not to be too small, the mop thread-pressing member does not generate a pressing force greater than is required. Further, in the latter half time period of the operation of the lever, the movement amount of the mop thread-pressing member cannot be too small and hence, it does not occur that the entire movement amount of the mop thread-pressing member cannot be secured.

Accordingly, the mop thread-squeezing apparatus having the above-described construction is capable of performing a mop thread-squeezing operation more effectively than the conventional one.

Further, it is preferable in the above construction that the pinion comprises a pair of plates which stack integrally on each other and have a row of teeth, respectively. The teeth of one plate and the other plate are spaced at half pitches. The rack comprises a pair of plates which stack integrally on each other and have, respectively, rows of teeth formed on the pair of plates which correspond to the rows of teeth provided on the pair of plates of the pinion.

With the above construction, the engagement between the teeth spaced at half pitches prevents the pinion and the rack from being loose. Thus, the rotational operation of the lever can be smoothly performed.

Further, according to the present invention, there is provided a mop thread-squeezing apparatus having the following construction.

The mop thread-squeezing apparatus comprises a mop thread-pressing plate which is provided in an upper portion of a squeezing tank comprising a pair of side plates connected with both sides of a net bottom plate and which is moved downward by operating a lever. The apparatus further comprises supporting portions provided on both sides of a lower portion of a front side of the squeezing tank and a lower portion of a rear side thereof; and a locking claw provided at the lower portion of the rear side of the squeezing tank. The front side means is on the side at which the lever is operated, namely, the side at which an operator is present. The rear side means is on the side opposite to the front side. The supporting portions comprise at least three points. A plurality of locking claws may be provided instead of one locking claw. The squeezing tank is mounted on the cleaning container by mounting the supporting portions on an edge of a cleaning container and locking a lower edge of a curl portion by means of the locking claw. In the state in which the squeezing tank is mounted on the cleaning container, the squeezing tank is located substantially above the upper edge of the cleaning container. That is, a part of the squeezing tank may be located below the edge of the cleaning container.

In the apparatus having the above-described construction, the supporting portions provided on both sides of the lower portion of the front side of the squeezing tank may be composed of supporting legs fixed to each of the side plates or of the supporting members fixed to the net bottom plate. The supporting portions and the locking claw located on the lower portion of the rear side of the squeezing tank may be provided directly on the net bottom plate of the squeezing tank or directly on both side plates. Further, the supporting portion and the locking claw may be provided through a separate member fixed between both side plates. Generally, a pair of one supporting portion and one locking claw is provided on the lower portion of the rear side of the squeezing tank in such a manner that the supporting portion and the locking claw are opposed to each other. But the position of the supporting portion and that of the locking claw may be altered to each other. The number of the supporting portions and that of the locking claws may be different from each other. There may be provided a plurality of the supporting portions and/or a plurality of the locking claws.

In using the apparatus having the above-described construction, the apparatus is mounted on the cleaning container by means of the supporting portion and supported in at least three positions. The mop thread placed on the net bottom plate is compressed by the mop thread-pressing member by operating the lever so as to squeeze out cleaning liquid contained in the mop thread. The cleaning liquid thus squeezed drips from meshes of the net bottom plate to the cleaning container and collected.

In operating the lever, the apparatus is supported by the supporting portion and the locking claw located at the rear side of the squeezing tank. That is, when a moment generated by a lever operation acts on the apparatus, the supporting portion presses downward the upper edge of the cleaning container, whereas the locking claw locks the lower edge of the curl portion of the cleaning container, thus preventing the apparatus from being moved upward. That is, the locking claw applies a force to lift the cleaning container. The apparatus is subjected to the force acting vertically, namely, the force acting in the direction in which the peripheral wall of the cleaning container extends, whereas in the conventional apparatus, a force is applied to the peripheral wall of the cleaning container at a right angle therewith.

Accordingly, the apparatus having the above-described construction is not damaged when the lever is operated.

In the apparatus having the above-described construction, the acting point of the force generated in the final stage of the lever operation can be located in a region in which a supporting force is received from a caster. Thus, the apparatus is stable in operating the lever. That is, in the conventional apparatus, the point at which the lever is operated, namely, the acting point of the force generated in the final stage of the lever operation is located outside the cleaning container. A moment is generated due to the operation force for pressing the lever downward and an upward supporting force of the caster. As a result, there is a high possibility that the apparatus falls down. In the conventional apparatus, because it is inserted into the cleaning container, the lever-fixing position is located in a limited range. Thus, the entire lever cannot be shifted. Further, the length of the lever cannot be reduced to obtain a predetermined degree of mop thread-compressing force. Therefore, the problem that the apparatus falls down cannot be easily solved. In the apparatus having the above-described construction, because the squeezing tank having the lever-fixing driving shaft may be placed above the cleaning container, the entire squeezing tank may be shifted to the rear side of the apparatus so as to move the lever-fixing position toward the outside of the cleaning container. In this manner, the acting point of the force generated in the lever operation can be positioned within a range or a region in its vicinity in which the supporting force of the caster is received. Accordingly, there is a low possibility that the apparatus having the above-described construction falls down and the apparatus is stable during the lever operation.

In addition, because the squeezing tank is located above the upper edge of the cleaning container when the apparatus having above-described construction is installed thereon, the width of the net bottom plate is not restricted by the size of the upper edge of the cleaning container. That is, the width of the net bottom plate of the apparatus of the present invention can be set to be greater than that of the net bottom plate of the conventional apparatus. Accordingly, the mop thread of less than 6 inches (18 cm) is used in the conventional apparatus, whereas the mop thread of 24 cm or longer can be used in the apparatus of the present invention.

The apparatus having the above-described construction can be made to be more compact than the conventional apparatus in the height direction thereof. That is, in the conventional apparatus, in order to bring the squeezing tank into contact with the peripheral wall of the cleaning container at a possible lowest force in the lever operation, it is necessary to form a long cut-out on the side plate so as to space the edge of the cut-out at a possible longest distance from the upper edge of the cleaning container in bringing the edge of the cut-out into contact with the peripheral wall of the cleaning container. Thus, it is not easy to reduce the conventional apparatus in the height direction thereof. Unlike the conventional apparatus, it is easy to make the apparatus of the present invention having the above-described construction compact at the portion located below the squeezing tank.

Because the squeezing tank is located above the upper edge of the cleaning container, the squeezing tank of the apparatus of the present invention having the above-described construction is capable of containing more cleaning liquid than the conventional apparatus. Thus, the apparatus of the present invention has a higher operability than the conventional apparatus.

Furthermore, the area of the open portion, of the cleaning container, through which the mop thread is inserted can be made to be greater than that of the conventional apparatus by shifting the squeezing tank toward the outside of the periphery of the cleaning container.

Preferably, the supporting portion has a supporting leg having an upward cut-out, which engages the upper edge of the cleaning container, formed at a lower portion thereof.

In the above construction, the apparatus is placed in position by means of the cut-out formed on the supporting leg. Accordingly, the apparatus can be installed on the cleaning container easily and prevented from being dislocated from the installed position during use.

Preferably, the mop thread-squeezing apparatus further comprises a positioning leg in confrontation with the locking claw. The peripheral wall of the cleaning container is sandwiched between the locking claw and the positioning leg.

In the above construction, the apparatus can be fixed to the cleaning container reliably and prevented from being dislocated from the installed position.

Thus, the apparatus having the above-described construction can be moved together with the cleaning container by holding the lever, with the apparatus mounted on the cleaning container. In the conventional apparatus of hook type, the apparatus is fixed to the cleaning container unstably. Therefore, the apparatus cannot be moved together with the cleaning container.

Preferably, the mop thread-squeezing apparatus further comprises a trough means, provided in the periphery of the lower portion of the squeezing tank, for receiving squeezed liquid which has leaked from the squeezing tank and guiding the squeezed liquid toward the center of the lower portion of the squeezing tank.

In the above-described construction, the cleaning liquid squeezed out from the mop thread, namely, the squeezed liquid is received by the trough means and introduced into the cleaning container. Preferably, the trough means is provided to receive the squeezed liquid which has leaked from a part of the apparatus that hangs out of the cleaning container. It is not necessary to provide the trough means to receive the squeezed liquid which drops directly into the cleaning container after it leaks from the squeezing tank.

Accordingly, the cleaning liquid squeezed from the mop thread can be prevented from being splashed or dropped from the cleaning container. The trough means can be effectively used if a part of the squeezing tank is located outside the cleaning container.

BRIEF DESCRIPTION OF THE DRAWINGS

These and other objectives and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

A mop thread-squeezing apparatus 10, shown in FIGS. 7 through 11, according to an embodiment of the present invention is described in detail below.

Figure 7:
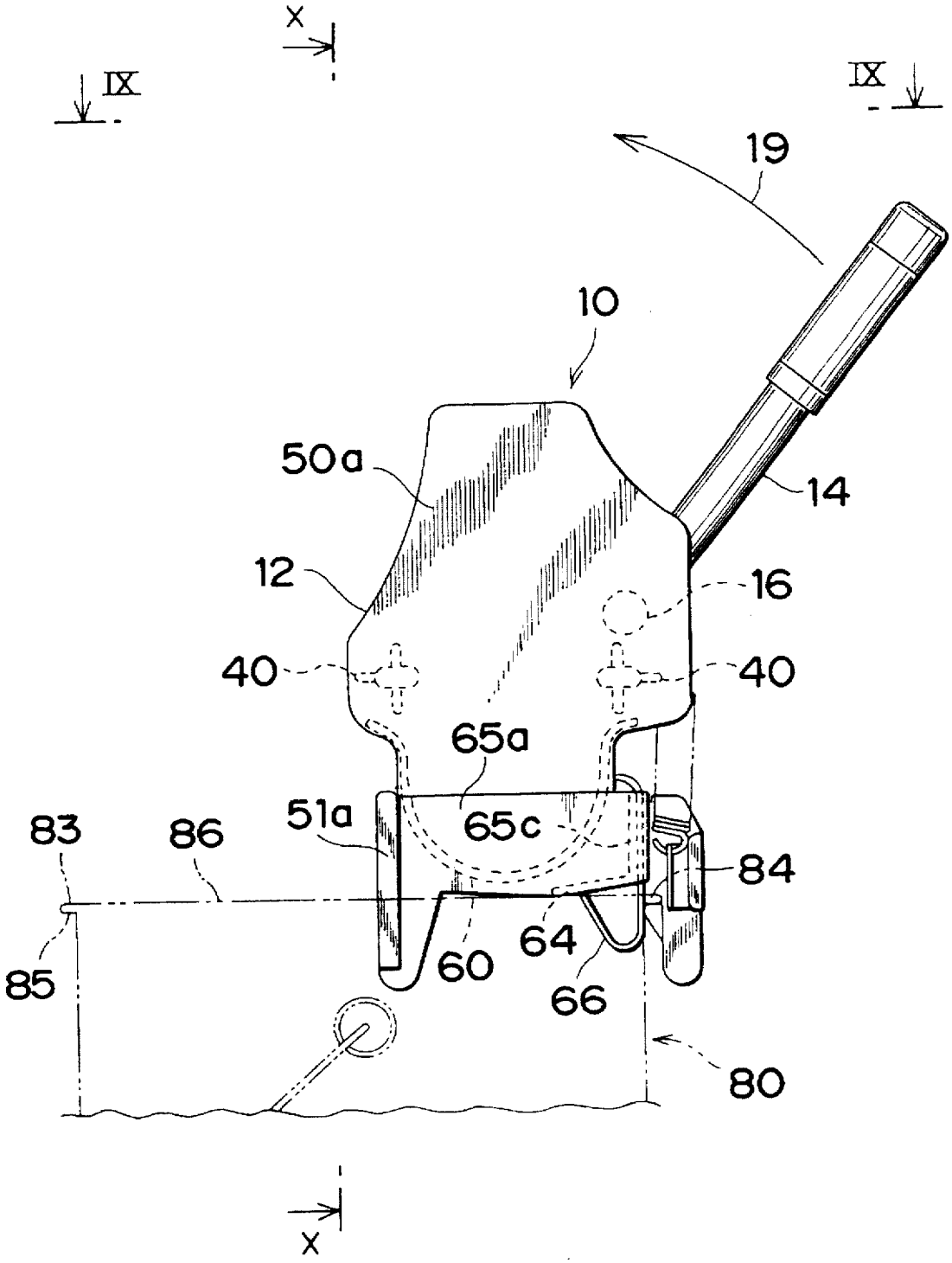
FIG. 7 is a side view showing a mop thread-squeezing apparatus according to an embodiment of the present invention.

As shown in FIG. 7, the mop thread-squeezing apparatus 10 comprises a squeezing tank 12; a lever 14; and a driving shaft 16.

Figure 8:
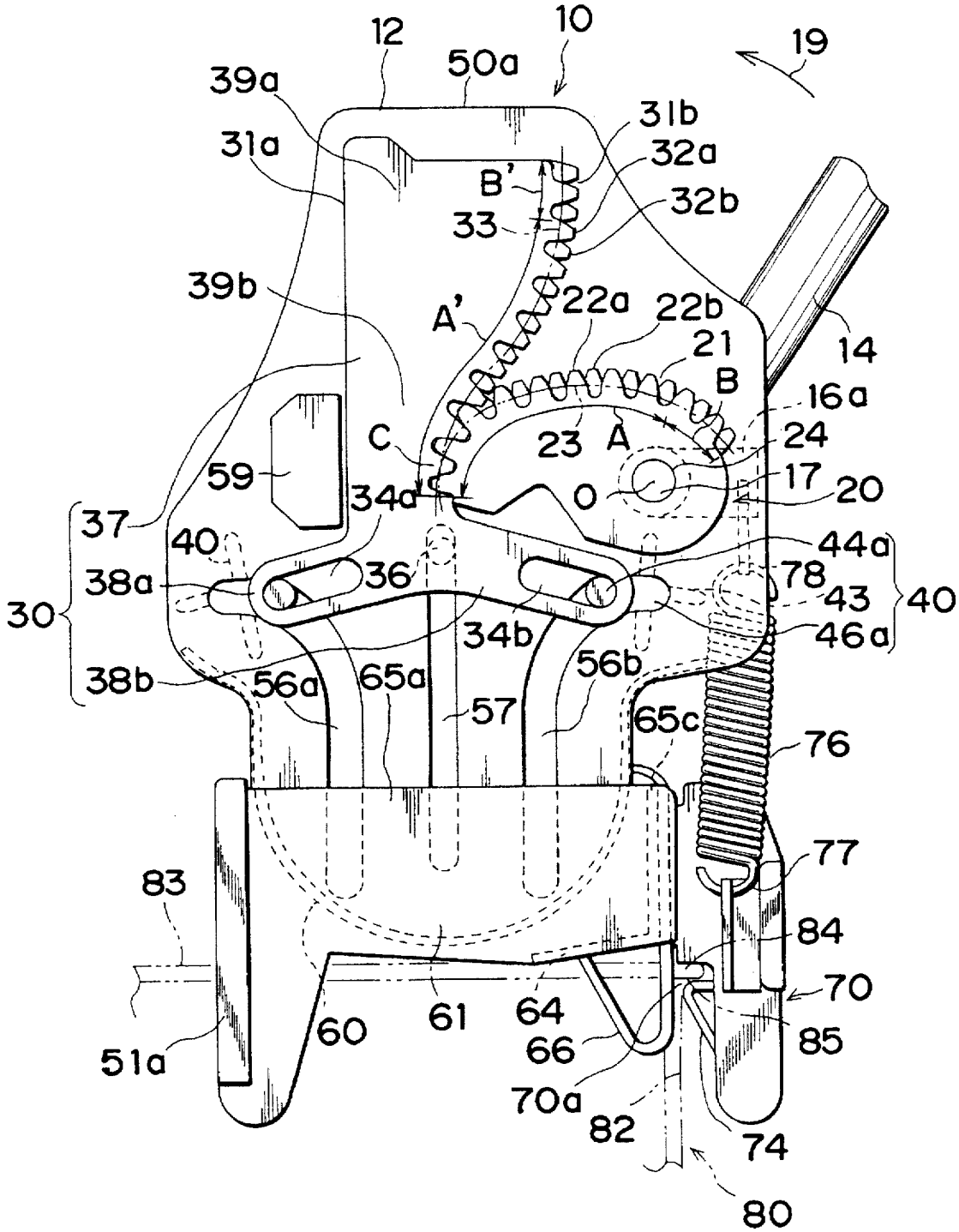
FIG. 8 is a partly broken-away sectional view showing main portions of the mop thread-squeezing apparatus shown in FIG. 7.
Figure 9:
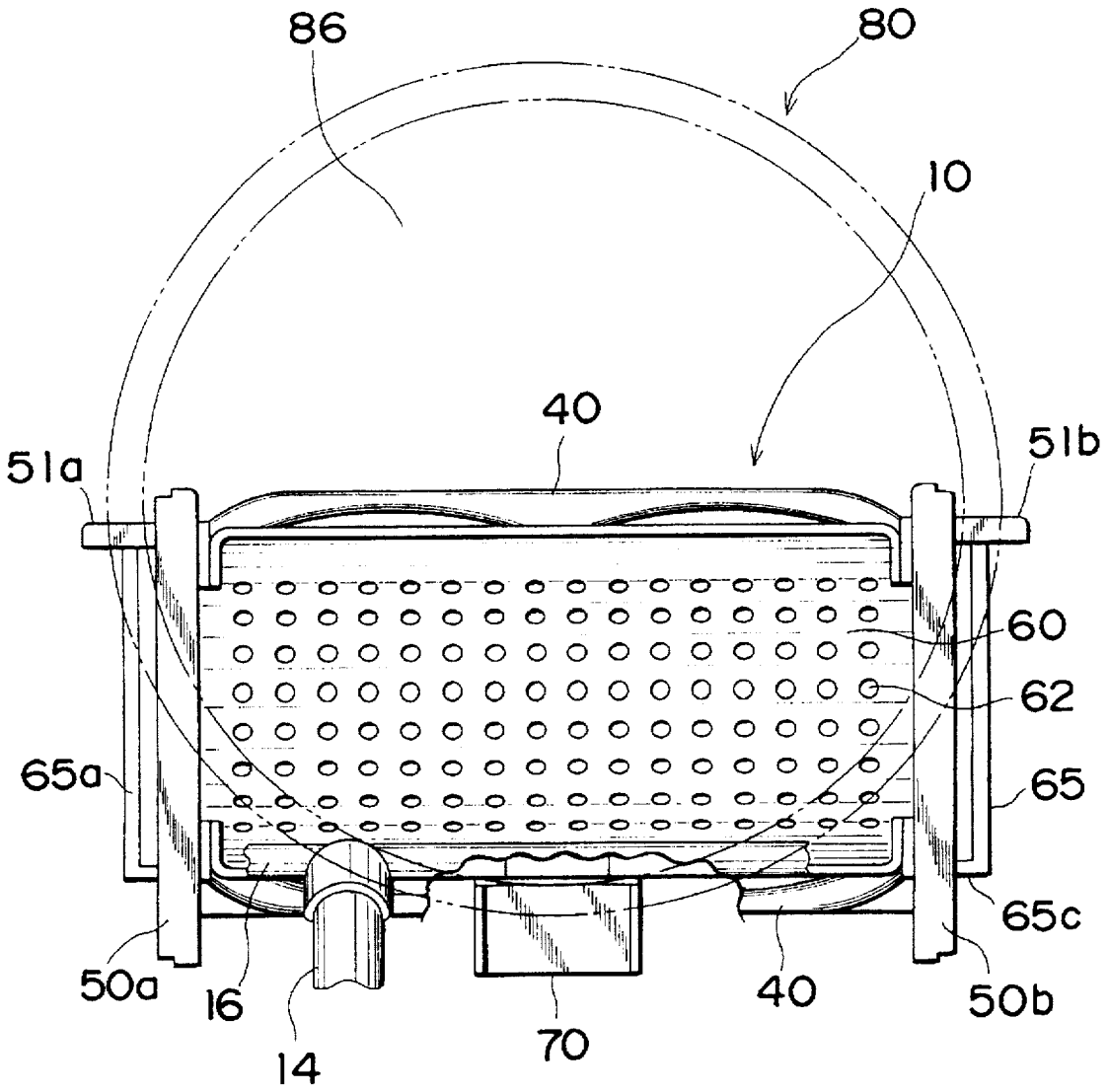
FIG. 9 is a plan view showing the mop thread-squeezing apparatus shown in FIG. 7.

As shown in FIGS. 8 and 9, the squeezing tank 12 is open in the upper portion thereof and approximately box-shaped, with a net bottom plate 60 approximately U-shaped connected with left and right side plates 50*a* and 50*b* thereof. As shown in FIG. 8, on each of the left and right side plates 50*a* and 50*b* of the squeezing tank 12, there are formed a pair of squeezing plate-guide holes 56*a* and 56*b*, a pair of rack guide holes 57, and a pair of driving shaft-supporting holes (not shown in FIG. 8) formed symmetrically. A pinion 20, a rack 30 engaging the pinion 20, and a rack guide plate 59 are mounted on an upper outer side of each of left and right side plates 50*a* and 50*b*. Each pinion 20, each rack 30, and each rack guide plate 59 are covered with a cover (not shown in FIG. 8). Left and right ends 17 of the driving shaft 16 are fixed to the driving shaft-fixing hole 24 formed in each of the left and right pinions 20. The left and right racks 30 support a pair of squeezing plates 40, respectively. The squeezing tank 12 has supporting portions 51*a* and 51*b* provided at a lower outer side thereof. As shown in FIG. 9, the lever 14 is fixed to the driving shaft 16. As shown in FIGS. 7 and 8, the lever 14 is positioned diagonally in an initial state, with the upper portion thereof positioned at the right-hand side of the apparatus 10. The left and right ends 17 of the driving shaft 16 are supported by a driving shaft-supporting hole (not shown) formed in each of the left and right side plates 50*a* and 50*b*.

The schematic construction of the squeezing tank 12 will be described below in detail.

As shown in FIG. 8, a pair of rows of teeth 22*a* and 22*b* are formed on the upper side 21 of the pinion 20 along a curved pitch circle 23 which is uncircular. That is, the radius of the pitch circle 23 between the rotation center (O) of the pinion 20 and the upper side 21 thereof are not constant. The detailed description of inconstant radius will be made later.

As shown in FIG. 8, the rack 30 is approximately Y-shaped. That is, the rack 30 comprises a center arm 37 extending vertically, a left arm 38*a*, and a right arm 38*b* both located at the lower end of the center arm 37. The left and right arms 38*a* and 38*b* form an inverted V-configuration. A guide projection 36 is formed on the center arm 37 of each rack 30 such that one guide projection 36 confronts the side plate 50*a* and the other guide projection 36 confronts the side plate 50*b*, thus slidably contacting each rack guide hole 57. One vertical side 31*a* of the center arm 37 is straight, thus slidably contacting the rack guide plate 59 of the side plates 50*a* and 50*b*. Teeth 32*a* and 32*b* engaging the teeth 22*a* and 22*b* of the pinion 20 are formed on the other vertical side 31*b* of the center arm 37. Supporting holes 34*a* and 34*b* for supporting each of the squeezing plates 40 are formed at the lower end of each of the left arm 38*a* and the right arm 38*b*.

Figure 1:
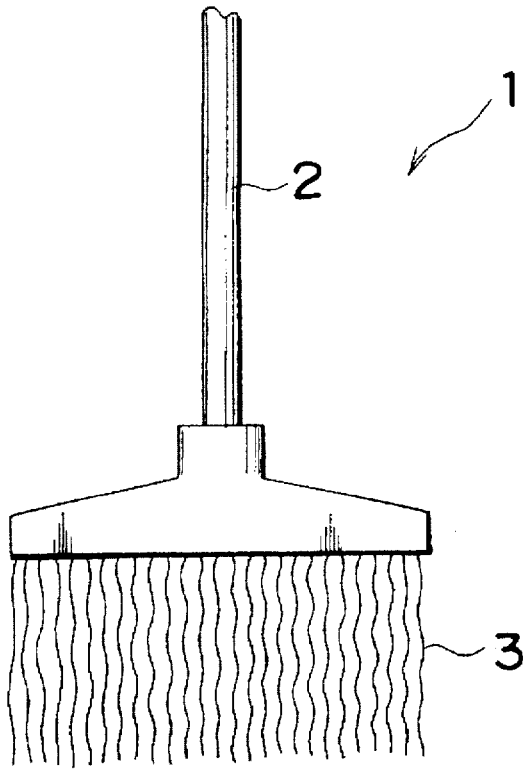
Fig. 1 PRIOR ART
FIG. 1 is a plan view showing a conventional mop.
Figure 2:
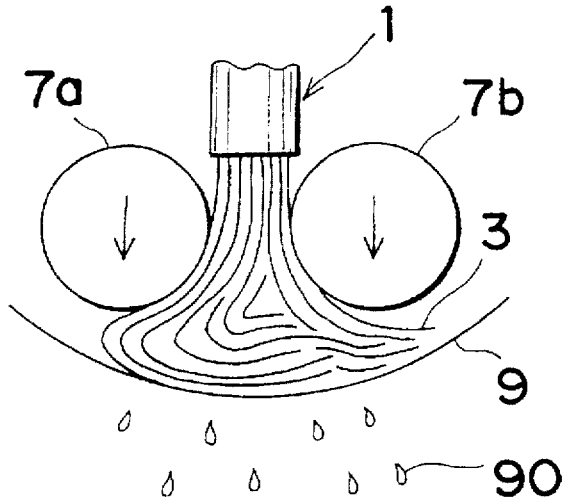
Fig. 2 PRIOR ART
FIG. 2 is an illustration showing main portions of a conventional mop thread-squeezing apparatus.
Figure 3:
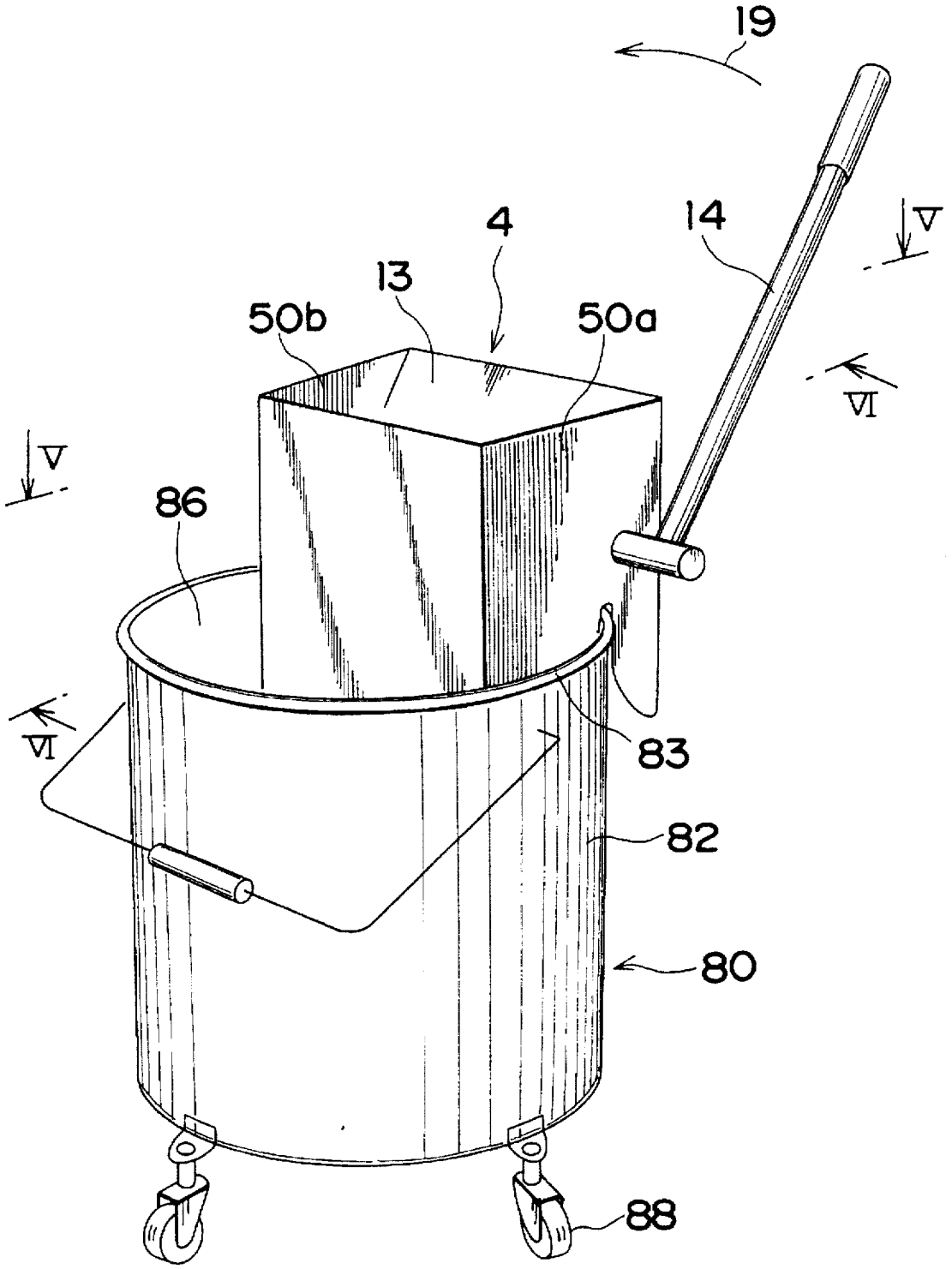
Fig. 3 PRIOR ART
FIG. 3 is a perspective view showing a state in which the conventional mop thread-squeezing apparatus is hooked on a pail can.
Figure 4:
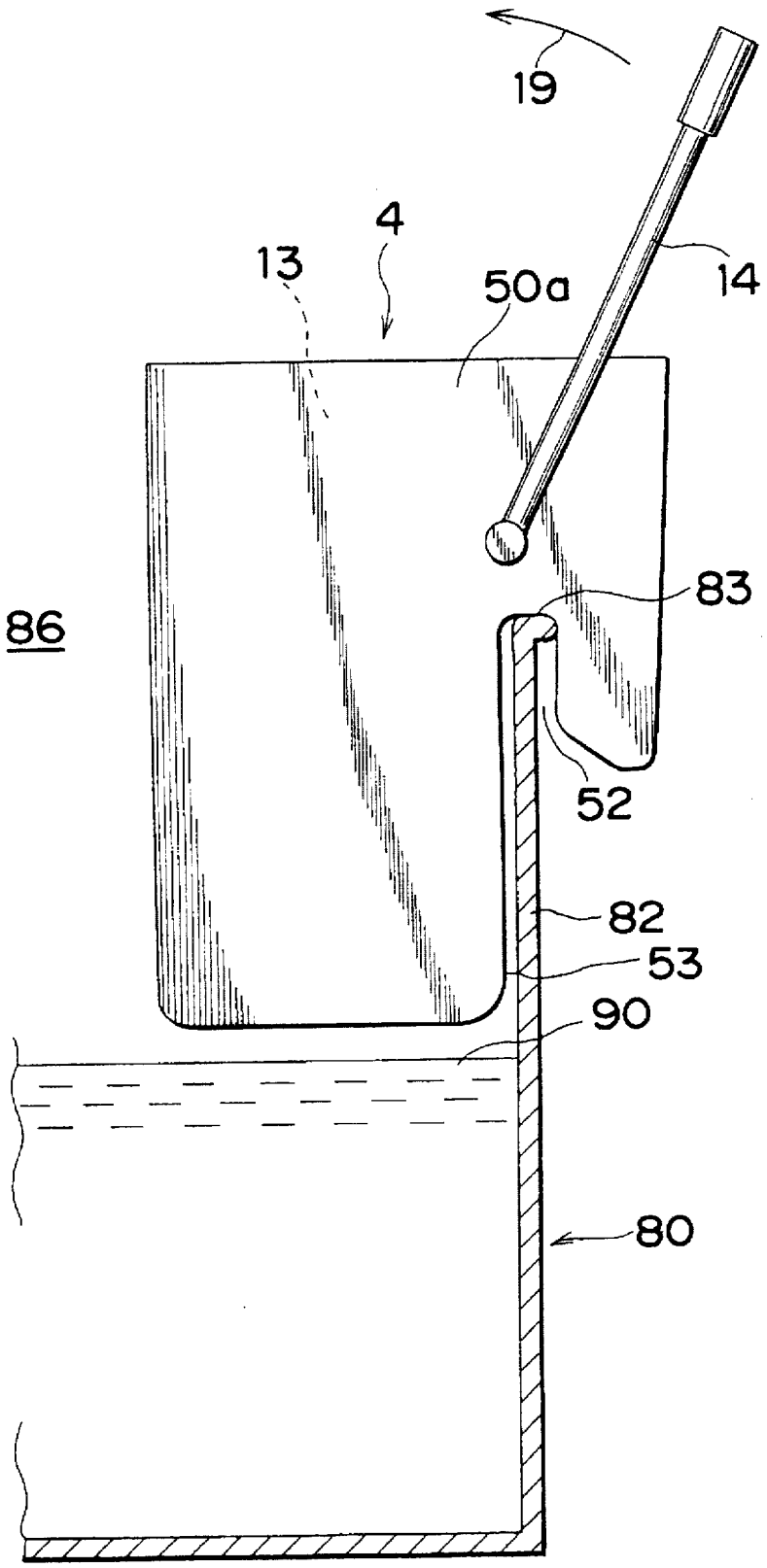
Fig. 4 PRIOR ART
FIG. 4 is a side view showing the apparatus shown in FIG. 3.
Figure 5:
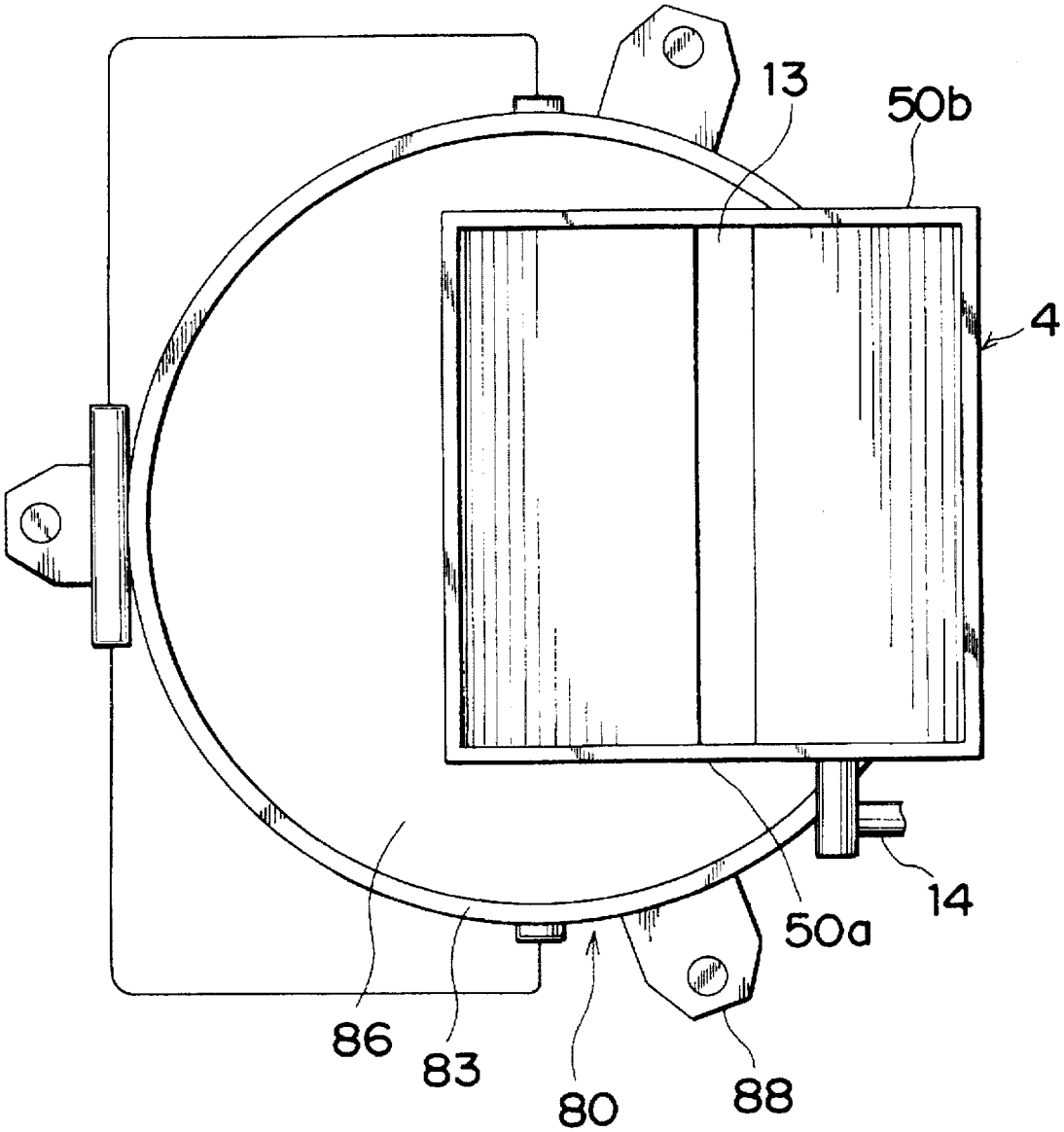
Fig. 5 PRIOR ART
FIG. 5 is a plan view showing the apparatus shown in FIG. 3.
Figure 6:
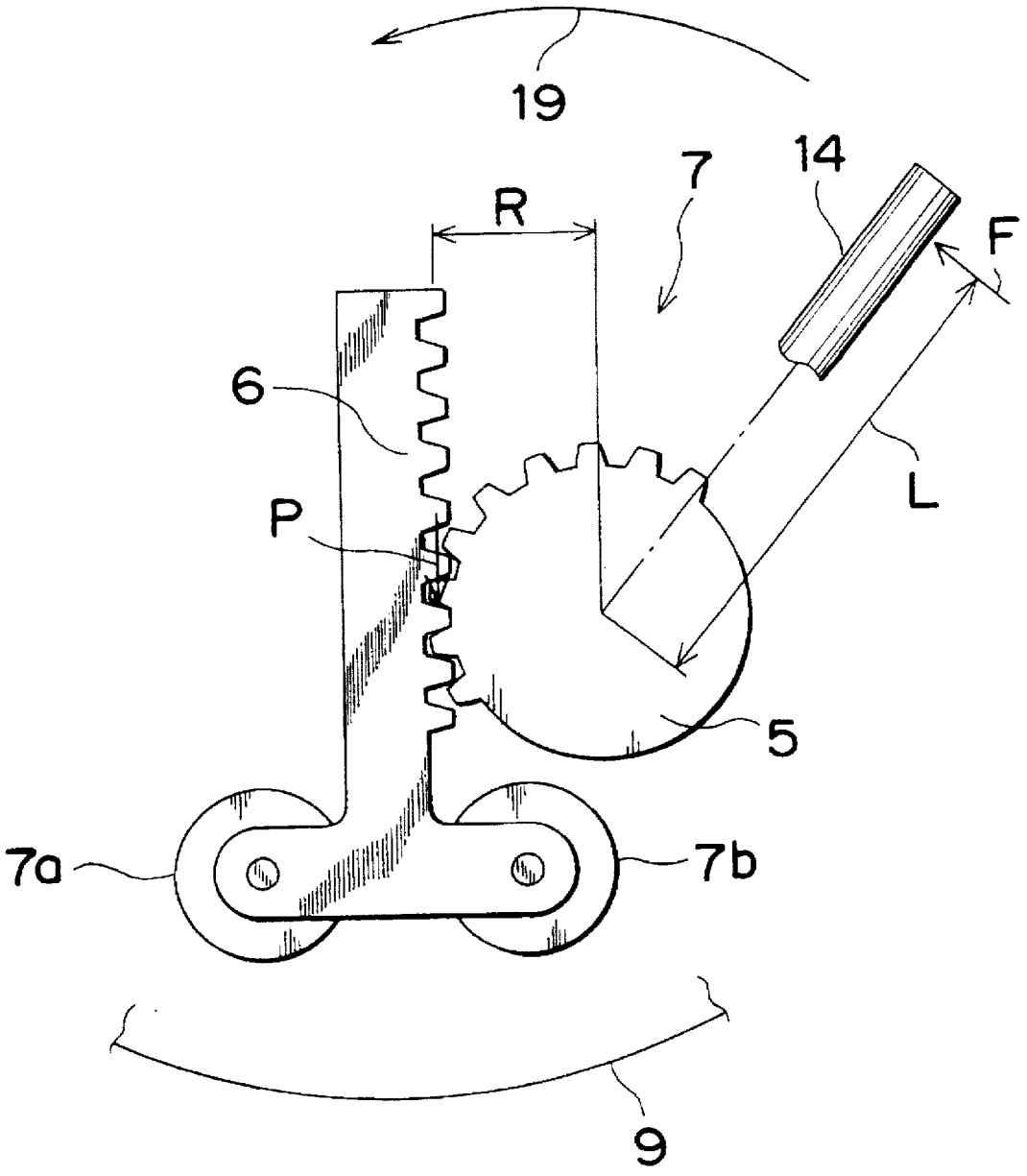
Fig. 6 PRIOR ART
FIG. 6 is an illustration showing a driving mechanism of the apparatus shown in FIG. 3.

The pinion 20 and the rack 30 are different from each of the pinion 5 and the straight rack 6 of the conventional mop thread-squeezing apparatus 4, shown in FIG. 6, in constructions thereof, respectively.

The pinion 20 to be rotated by a means of a lever 14 has a row of teeth having first and second ends.

The rack 30 engages the pinion 20 so as to be moved downward and upward due to a rotation of the pinion 20. The rack 30 includes a pair of rows of teeth 32*a*, 32*b* which corresponds to the rows of teeth 22*a*, 22*b* of the pinion 20 and has a lower end, at which the teeth 32*a*, 32*b* thereof engage the teeth 22*a*, 22*b* of the pinion 20 positioned at the first ends, i.e. the left ends viewed in FIG. 8, of the row of teeth, and an upper end at which the teeth 32*a*, 32*b* thereof engage the teeth 22*a*, 22*b* positioned at the second ends, i.e. the right ends viewed in FIG. 8, of the row of teeth of the pinion 20.

A pitch circle 23 of the pinion 20 extending between the first and second ends of the row of the teeth is uncircular such that a radius D-C of the pitch circle 23 becomes gradually smaller from the first ends of the rows of teeth toward the second end thereof. In detail, the rows of teeth of the pinion 20 have a first region (A) and a second region (B). The first region (A) includes the first ends of the rows of teeth in which leading half teeth engage the lower half teeth of the rack 30 in a former half time period of the squeezing operation 19 by means of the lever 14. The radius O-C of the pitch circle 23 of the pinion 20 becomes gradually smaller from the first ends of the rows of teeth 22*a*, 22*b* toward the other end thereof.

The second region (B) includes the second end of the rows of teeth 22*a*, 22*b* in which trailing half teeth engage upper half teeth of the rack 30 in a latter half time period of the squeezing operation 19 by means of the lever 14, in which the radius O-C of the pitch circle 23 of the pinion 20 is approximately constant.

Therefore, the pitch circle radius O-C of the pinion 20 at the point of contact between the pitch circle 23 of the pinion 20 and the pitch line 33 of the rack 30 is large when the pinion 20 engages the rack in a lower portion 39*b* of the rack 30 and becomes smaller as the engagement between the pinion 20 and the rack 30 shifts toward an upper portion 39*a* of the rack 30. When the pinion 20 engages the upper portion 39*a* of the rack 30, the pitch circle radius O-C of the pinion 20 is almost constant. The pitch line 33 of the rack 30 is curved and linear in correspondence to the pitch circle 23 of the pinion 20. In correspondence to the length of the radius O-C, the pitch line 33 of the rack 30 has a first region A' and a second region B'.

Although not essential, the teeth 22*a* and 22*b* of the pinion 20 and the teeth 32*a* and 32*b* of the rack 30 which engage the teeth 22*a* and 22*b* are spaced at half pitches, respectively. That is, the pinion 20 comprises two plates stacked and fixed with each other. The teeth 22*a* are formed on one plate, while the teeth 22*b* are formed on the other plate. Similarly, the rack 30 comprises two plate stacked and fixed with each other. The teeth 32*a* are formed on one plate, while the teeth 32*b* are formed on the other plate, the teeth 32*a* and 32*b* being spaced at half pitches. The engagement between the teeth spaced at half pitches prevents the pinion 20 and the rack 30 from being loose, thus allowing the operation of the lever 14 to be smoothly performed.

Figure 11I:
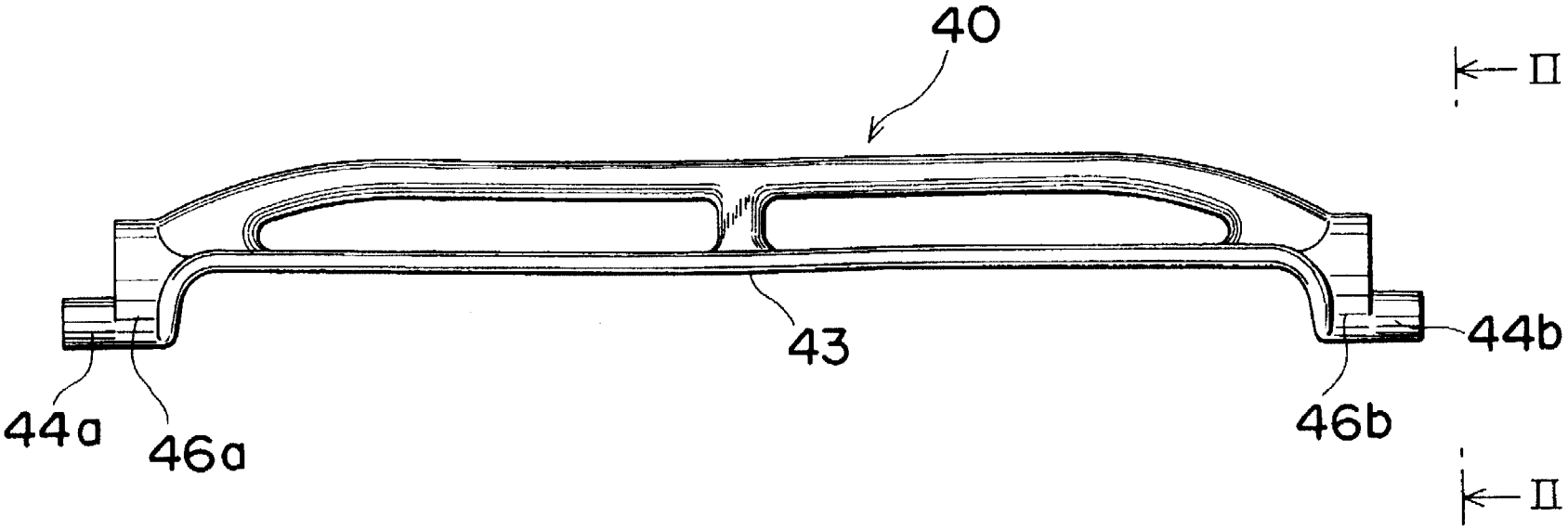
FIG. 11 is a view showing a squeezing plate of the apparatus shown in FIG. 7 in detail, in which FIG. 11-(I) is a front view showing a pressing portion of the squeezing plate, and FIG. 11-(II) is an end view showing an end surface of the pressing portion of the squeezing plate.
Figure 11:
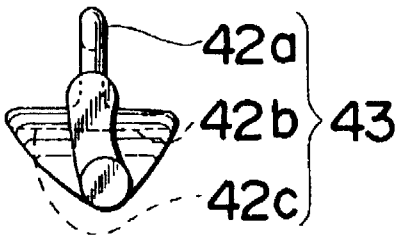

As shown in FIG. 11, each squeezing plate 40 comprises a pressing portion 43 having three squeezing blades 42*a*, 42*b*, and 42*c* connected with each other along the same axis to form a T-shaped configuration in section; sliding-contact portions 46*a* and 46*b* adjacent to the pressing portion 43 in the axial direction of the squeezing plate 40; and supporting projections 44*a* and 44*b* formed outward from each of the sliding-contact portions 46*a* and 46*b* in the axial direction of the squeezing plate 40. As shown in FIG. 8, a pair of the squeezing plates 40 is supported by the left and right arms 38*a* and 38*b* of the left and right racks 30 with the supporting projections 44*a* and 44*b* inserted in the squeezing plate-supporting holes 34*a* and 34*b* thereof, respectively. The sliding-contact portions 46*a* and 46*b* are slidably inserted in the squeezing plate-guide holes 56*a* and 56*b* of the left and right side plates 50*a* and 50*b*, respectively.

Figure 10:
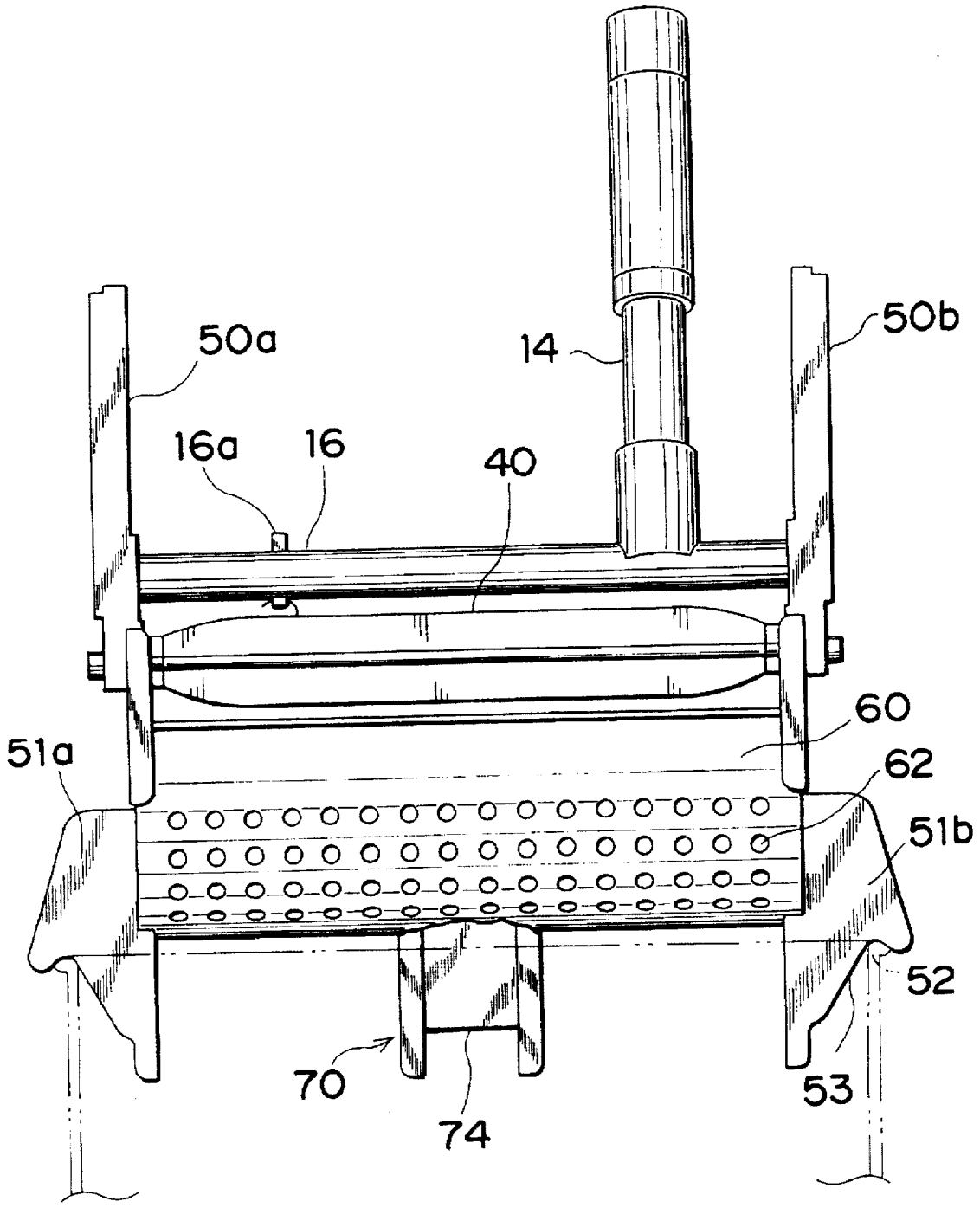
FIG. 10 is a rear view showing the mop thread-squeezing apparatus shown in FIG. 7.

As shown in FIGS. 9 and 10, the left and right side plates 50*a* and 50*b* have supporting legs 51*a* and 51*b* extending outward in a right angle with each of the side plates 50*a* and 50*b* from a lower portion of the side thereof opposite to the side thereof at which the lever 14 is provided. As shown in FIG. 10, an upward cut-out 52 is formed at a lower portion of each of the supporting legs 51*a* and 51*b*.

As shown in FIGS. 9 and 10, a large number of through-holes 62 is formed at the lower portion of the bottom plate 60 to form a net. As shown in FIGS. 7 and 8, a receiving plate 64 extending below the bottom plate 60 is connected with the left and right side plates 50*a* and 50*b* on the side thereof at which the lever 14 is provided. As shown in FIGS. 8 and 9, the other receiving plates 65*a*, 65*b*, and 65*c* are provided outward of each of the side plates 50*a* and 50*b* and the bottom plate 60 in such a manner that the receiving plates 65*a*, 65*b*, and 65*c* surround the lower periphery of the squeezing tank 12. The receiving plates 65*a*, 65*b*, and 65*c* are connected with each other with no gaps formed therebetween, thus constituting a trough means. A positioning leg 66 is fixed to the bottom plate 60 at the center of the rear surface thereof and the lower surface of the receiving plate 64. A buckle 70 facing downward is fixed to the outer side surface of the positioning leg 66. One end 77 of a spring 76 is fixed to an upper portion of the buckle 70. The other end 78 of the spring 76 is fixed to a spring-mounting plate 16*a* projecting from the rear side of the driving shaft 16 at a right angle therewith. A cut-out 70*a* is formed on a side surface of the buckle 70. A locking claw 74 is withdrawably projected downward from the lower center of the buckle 70 in the direction in which the positioning leg 66 extends.

The operation of the apparatus is described below.

When the lever 14 is pivoted in the squeezing direction shown by arrows 19 of FIGS. 7 and 8, the pinion 20 is rotated in the same direction as the squeezing direction. As a result, the rack 30 engaging the pinion 20 is guided by the rack guide hole 57 and the rack guide plate 59, thus moving downward together with the squeezing plates 40.

In an early time period before the squeezing operation is performed, the tensile force of the spring 76 causes the driving shaft 16 to rotate, thus lifting the rack 30; the sliding-contact portions 46*a* and 46*b* of the squeezing plate 40 are guided by each of the squeezing plate-guide holes 56*a* and 56*b* of each of the left and right side plates 50*a* and 50*b*;

and the squeezing plate 40 is located at the lower end of the squeezing plate-supporting holes 34*a* and 34*b* of each of the left and right arms 38*a* and 38*b* of the rack 30. In this state, there is the greatest interval between the sliding-contact portions 46*a* and 46*b* of the squeezing plate 40.

When the rack 30 moves downward against the tensile force of the spring 76 due to the operation of the lever 14, the squeezing plate 40 moves downward by the guide of the two squeezing plate-guide holes 56*a* and 56*b* spaced at a great interval in the upper portion thereof and vertically parallel with each other in the lower portion thereof. That is, both squeezing plates 40 move downward while they are moving inward, thus shortening the interval therebetween, and thereafter, move downward further in parallel with each other, while they keep a constant interval therebetween.

In the former half time period of the lever operation, the pinion 20 engages the rack 30 in the first region (A) having a relatively large pitch circle radius O-C. Therefore, the rate of the downward movement of the rack 30, namely, the amount of the downward movement thereof with respect to the rotation angle of the lever 14 is great. With the progress of the lever operation, the radius O-C of the pitch circle 23 of the pinion 20 becomes gradually smaller. Thus, the rate of the downward movement of the rack 30 becomes gradually smaller. In the latter half time period of the lever operation, the pinion 20 engages the rack 30 in the second region (B) having an almost constant radius O-C of the pitch circle 23. Thus, the rate of the downward movement of the rack 30 becomes almost constant. That is, in the former half time period of the lever operation, the squeezing plate 40 moves downward rapidly, while in the latter half time period thereof, it moves downward at an almost constant rate.

Before the lever 14 is operated, the interval between both squeezing plates 40 is wide. Thus, it is easy to insert the mop thread 3 through the squeezing plates 40 and place it on the bottom 61 of the interior 12 of the apparatus 10, namely, on the bottom plate 60. In the former half time period of the lever operation, the interval between the squeezing plates 40 becomes short and the squeezing plates 40 approach the mop thread 3 placed on the bottom plate 60. In the latter half time period of the lever operation, the squeezing plates 40 compress the mop thread 3. An operation force (F) applied to the lever 14 acts as a pressing force (P): $P=(L/R)\times F$, in proportion to the ratio of the length (L) of the lever 14 to the radius O-C, namely, (R) of the pitch circle of the pinion 20.

In the conventional apparatus 4 having the driving mechanism 7 shown in FIG. 6, there is a limitation in the radius (R) of the pitch circle of the pinion 5. Thus, the pressing force (P) cannot be generated sufficient by a normal degree of the operation force (F). That is, the mop thread 3 cannot be squeezed sufficiently.

In the apparatus 10 having the above-described construction, in the latter half time period of the lever operation required to generate the great pressing force (P), the radius O-C, namely, (R) of the pitch circle 23 of the pinion 20 is set to be smaller than that of the pitch circle of the pinion 5 of the conventional apparatus 4 to generate the greater pressing force (P) when the same operation force (F) is applied. This construction reduces the movement amount (change rate in movement amount of mop thread-squeezing member relative to pivoted angle of lever) of the mop thread-squeezing member in the latter half time period of the lever operation, but the movement amount of the mop thread-squeezing member is allowed to be great in the former half time period of the lever operation. Thus, the entire movement amount of the mop thread-squeezing member of the apparatus 10 is equal to that of the conventional apparatus 4. That is, in the latter half time period of the lever operation, because the radius O-C of the pitch circle 23 of the pinion 20 is set to be small, the downward movement of the rack 30 is small, but in the former half time period of the lever operation in which no great pressure onto the mop thread is required, the radius O-C of the pitch circle 23 of the pinion 20 is set to be large to increase the downward movement of the squeezing plate 40 so as not to degrade the operability of the apparatus 10.

Accordingly, the apparatus 10 having the above-described construction is capable of sufficiently squeezing the mop thread 3 at the great pressing force (P) thereto by operating the lever 14 without deteriorating the operability of the apparatus 10.

If the radius O-C of the pitch circle 23 of the pinion 20 is set to be gradually smaller in the latter half time period of the lever operation, not only a great pressing force (P) more than is required is generated, but also the rate of the downward movement of the squeezing plate 40 becomes small. Thus, in the apparatus 10 having the above-described construction, the radius O-C of the pitch circle 23 of the pinion 20 is set to be constant or approximately constant in the latter half time period of the lever operation to generate the pressing force (P) in an appropriate degree and prevent the rate of the downward movement of the squeezing plate 40 from being reduced to be excessively small.

The method of using the apparatus 10 is described below.

As shown in FIG. 7, the apparatus 10 is used in a stationary state, with the apparatus 10 positioned on an upper edge 83 of a peripheral wall 82 of a cleaning container 80 containing cleaning liquid 90. That is, in the apparatus 10, to fix the squeezing tank 12 to the cleaning container 80, the peripheral wall 82 of the cleaning container 80 is inserted into the cut-out 52 of each of the left and right supporting legs 51*a* and 51*b* and into the cut-out 70*a* of the buckle 70 to support the apparatus 10 by the upper edge 83 of the cleaning container 80. At the same time, as shown in FIG. 8, the peripheral wall 82 of the cleaning container 80 is sandwiched between the positioning leg 66 and the locking claw 74 of the buckle 70; a curl portion 84 of the upper edge 83 of the cleaning container 80 is sandwiched between the cut-out 70*a* of the buckle 70 and the upper surface of the locking claw 74; and the locking claw 74 locks the lower edge 85 of the curl portion 84. In this state, the bottom plate 60 is positioned above the upper edge 83 of the cleaning container 80; and the squeezing tank 12 covers the upper portion of the cleaning container 80, with a sufficiently large opening 86 provided, as shown in FIG. 9. Containers for exclusive use for the cleaning container 80 may be prepared, but a so-called pail can having a volume of about 20 liters generally used as a container for containing wax can be converted into the cleaning container 80, with a caster 88 installed on the bottom thereof.

As shown in FIGS. 7 and 9, an operator immerses the mop thread 3 in the cleaning liquid 90 contained in the cleaning container 80 by putting it thereinto from the open portion 86 thereof to wash it, and then, inserts it into the interior 13 of the apparatus 10 from above the apparatus 10. That is, the operator inserts the mop thread 3 between a pair of the squeezing plates 40, thus placing it on the bottom plate 60. Then, with the operator holding the handle 2 of the mop 1 with one hand, the operator pulls the lever 14 with the other hand in the direction shown by the arrow 19, i.e., pulls toward the operator. As a result of the lever operation, the interval between the squeezing plates 40 becomes small and then, the squeezing plates 40 move downward, with the result that the pressing force (P) proportional to the operation force (F) of the lever 14 acts on the mop thread 3. The cleaning liquid 90 squeezed out from the mop thread 3 flows into the cleaning container 80 directly from the through-holes 62 of the bottom plate 60 or flows into the cleaning container 80 by being guided by the receiving plates 65*a*, 65*b*, and 65*c* surrounding the three sides of the squeezing tank 12 and the receiving plate 64 extending below the bottom plate 60. That is, the cleaning liquid 90 contained in the mop thread 3 is squeezed.

Although a moment to lift the positioning leg 66 acts on the apparatus 10 due to the lever operation, the locking claw 74 of the buckle 70 locks the lower edge 85 of the curl portion 84 of the cleaning container 80. Thus, the apparatus 10 is not lifted. Therefore, the edge 53 of the cut-out 52 of each of the supporting legs 51*a* and 51*b* is not brought into contact with the peripheral wall 82 of the cleaning container 80 in the lever operation.

Accordingly, because a force does not act on the peripheral wall 82 of the cleaning container 80 in a direction perpendicular thereto, the cleaning container 80 is not concaved or damaged.

The mop thread-squeezing apparatus 10 having the above-described construction is superior to the conventional apparatus 4 in other points.

That is, in the conventional apparatus 4, the squeezing tank is partly located inside the cleaning container, whereas in the mop thread-squeezing apparatus 10 having the above-described construction, the squeezing tank 12 is not located inside the cleaning container 80 but located above the cleaning container 80. Therefore, the width of the bottom plate 60 of the squeezing tank 12 is not restricted by the cleaning container 80. Accordingly, the apparatus 10 having the above-described construction is capable of using the wide mop thread 3. Therefore, supposing that the cleaning container 80 of the same size is used in both the conventional apparatus 4 and the apparatus 10, the mop thread having a larger width can be used in the latter. For example, when the pail can is used as the cleaning container 80 in both apparatuses, the mop thread 3 having the width of 6 inches (18 cm) is used in the former, whereas the mop thread 3 having the width of 8 inches (24 cm) or longer can be used in the latter.

In addition, because the apparatus 10 having the above-described construction is fixed to the upper portion of the cleaning container 80, the apparatus 10 reduces the area of the opening of the cleaning container 80. Thus, the open portion 86 of the apparatus 10 can be made to be greater than that of the conventional apparatus 4. Further, because the apparatus 10 having the above-described construction is not located inside the cleaning container 80, more cleaning liquid 90 can be contained in the cleaning container 80 thereof. Thus, the apparatus 10 is more operable than the conventional apparatus 4.

Moreover, because the apparatus 10 is firmly fixed to the cleaning container 80 by means of the buckle 70, the apparatus 10 can be installed on the cleaning container 80 more stably than the conventional apparatus 4 of hook type. Thus, the apparatus 10 can be moved together with the cleaning container 80 by pushing or pulling the lever 14, with the former installed on the latter.

The present invention is not limited to the above-described embodiment, but may be embodied in various modes. For example, the pinion 20 and the rack 30 can be constructed in such a manner that the pitch line 33 of the rack 30 is straight. Further, instead of the squeezing plate 40, rollers 7*a* and 7*b* may be used as the mop thread-pressing member. Further, it is possible to replace the lever 14 to be manually operated with a pedalling means in order to rotate the pinion 20.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A mop thread-squeezing apparatus for mounting on a cleaning container, said cleaning container having an upper edge with a curl portion, said curl portion having a lower edge, said apparatus comprising:

a squeezing tank with a pair of side plates and a net bottom plate, the net bottom plate being connected at each of opposite ends to one of the side plates, said squeezing tank having a front side and a rear side;

a mop thread-pressing plate and a lever connected to the mop thread-pressing plate, said mop thread-pressing plate being operably positioned in an upper portion of the squeezing tank so as to move downwardly by operating the lever;

supporting portions provided on both sides of a lower portion of a front side of the squeezing tank and a lower portion of a rear side thereof, the supporting portions on the front side of the squeezing tank each having a supporting leg with an upward cut-out, which engages the upper edge of the cleaning container, formed at a lower portion thereof, and a locking claw provided at the lower portion of the rear side of the squeezing tank, whereby, the squeezing tank is mounted on the cleaning container by mounting the supporting portions on the upper edge of the cleaning container and locking the lower edge of the curl portion by means of the locking claw such that the squeezing tank is located substantially above the upper edge of the cleaning container.

2. A mop thread-squeezing apparatus for mounting on a cleaning container with a peripheral wall, said peripheral wall having an upper edge with a curl portion, said curl portion having a lower edge, said apparatus comprising:

a squeezing tank with a pair of side plates and a net bottom plate, the net bottom plate being connected at each of opposite ends to one of the side plates, said squeezing tank having a front side and a rear side;

a mop thread-pressing plate and a lever connected to the mop thread-pressing plate, said mop thread-pressing plate being operably positioned in an upper portion of the squeezing tank so as to move downwardly by operating the lever;

supporting portions provided on both sides of a lower portion of a front side of the squeezing tank and a lower portion of a rear side thereof;

a locking claw provided at the lower portion of the rear side of the squeezing tank; and a positioning leg in confrontation with the locking claw, said peripheral wall of the cleaning container being sandwiched between the locking claw and the positioning leg;

whereby, the squeezing tank is mounted on the cleaning container by mounting the supporting portions on the upper edge of the cleaning container and locking the lower edge of the curl portion by means of the locking claw such that the squeezing tank is located substantially above the upper edge of the cleaning container.

3. A mop thread-squeezing apparatus for mounting on a cleaning container, said cleaning container having an upper edge with a curl portion, said curl portion having a lower edge, said apparatus comprising:

a squeezing tank with a pair of side plates and a net bottom plate, the net bottom plate being connected at each of opposite ends to one of the side plates;

a trough means, provided in the periphery of the lower portion of the squeezing tank, for receiving squeezed liquid which has leaked from the squeezing tank and guiding the squeezed liquid toward a center of the lower portion of the squeezing tank;

a mop thread-pressing plate and a lever connected to the mop thread-pressing plate, said mop thread-pressing plate being operably positioned in an upper portion of the squeezing tank so as to move downwardly by operating the lever;

supporting portions provided on both sides of a lower portion of a front side of the squeezing tank and a lower portion of a rear side thereof, and a locking claw provided at the lower portion of the rear side of the squeezing tank, whereby, the squeezing tank is mounted on the cleaning container by mounting the supporting portions on the upper edge of the cleaning container and locking the lower edge of the curl portion by means of the locking claw such that the squeezing tank is located substantially above the upper edge of the cleaning container.

* * * * *